US006350366B1

(12) United States Patent
Landau et al.

(10) Patent No.: US 6,350,366 B1
(45) Date of Patent: Feb. 26, 2002

(54) ELECTRO DEPOSITION CHEMISTRY

(75) Inventors: Uziel Landau, Shaker Heights; John J. D'Urso, Niles; David B. Rear, Chardon, all of OH (US)

(73) Assignee: Applied Materials, Inc., Santa Clara, CA (US)

( * ) Notice: Subject to any disclaimer, the term of this patent is extended or adjusted under 35 U.S.C. 154(b) by 0 days.

(21) Appl. No.: 09/484,616

(22) Filed: Jan. 18, 2000

Related U.S. Application Data

(63) Continuation of application No. 09/114,865, filed on Jul. 13, 1998, now Pat. No. 6,113,771.

(60) Provisional application No. 60/082,521, filed on Apr. 21, 1998.

(51) Int. Cl.[7] ..... C25D 7/12; C25D 3/38

(52) U.S. Cl. ..... 205/182; 205/186; 205/291; 205/296

(58) Field of Search ..... 205/159, 298, 205/157, 182, 184, 291, 296

(56) References Cited

U.S. PATENT DOCUMENTS

| | | | | |
|---|---|---|---|---|
| 2,742,413 A | | 4/1956 | Cransberg et al. | 204/52 |
| 2,882,209 A | | 4/1959 | Brown et al. | 204/52 |
| 3,727,620 A | | 4/1973 | Orr | 134/95 |
| 3,770,598 A | | 11/1973 | Creutz | 204/52 R |
| 4,027,686 A | | 6/1977 | Shortes et al. | 134/33 |
| 4,092,176 A | | 5/1978 | Kozai et al. | 134/186 |
| 4,110,176 A | | 8/1978 | Creutz et al. | 204/52 R |
| 4,113,492 A | | 9/1978 | Sato et al. | 96/67 |
| 4,315,059 A | | 2/1982 | Raistrick et al. | 429/112 |
| 4,336,114 A | | 6/1982 | Mayer et al. | 284/52 |
| 4,376,685 A | | 3/1983 | Watson | 204/52 R |
| 4,405,416 A | | 9/1983 | Raistrick et al. | 204/68 |
| 4,489,740 A | | 12/1984 | Rattan et al. | 134/140 |
| 4,510,176 A | | 4/1985 | Cuthbert et al. | 427/82 |
| 4,518,678 A | | 5/1985 | Allen | 430/311 |
| 4,519,846 A | | 5/1985 | Aigo | 134/15 |
| 4,693,805 A | | 9/1987 | Quazi | 204/192.22 |
| 4,732,785 A | | 3/1988 | Brewer | 427/240 |
| 5,039,381 A | | 8/1991 | Mullarkey | 204/47.5 |
| 5,055,425 A | | 10/1991 | Leibovitz et al. | 437/195 |
| 5,155,336 A | | 10/1992 | Gronet et al. | 219/411 |
| 5,162,260 A | | 11/1992 | Leibovitz et al. | 437/195 |
| 5,222,310 A | | 6/1993 | Thompson et al. | 34/202 |
| 5,224,504 A | | 7/1993 | Thompson et al. | 134/155 |
| 5,230,743 A | | 7/1993 | Thompson et al. | 134/32 |
| 5,252,807 A | | 10/1993 | Chizinsky | 219/390 |
| 5,256,274 A | | 10/1993 | Poris | 205/123 |
| 5,259,407 A | | 11/1993 | Tuchida et al. | 134/151 |
| 5,290,361 A | | 3/1994 | Hayashida et al. | 134/2 |
| 5,316,974 A | | 5/1994 | Crank | 437/190 |
| 5,328,589 A | | 7/1994 | Martin | 205/296 |
| 5,349,978 A | | 9/1994 | Sago et al. | 134/153 |
| 5,368,711 A | | 11/1994 | Poris | 204/193 |
| 5,377,708 A | | 1/1995 | Bergman et al. | 134/105 |
| 5,429,733 A | | 7/1995 | Ishida | 204/224 R |
| 5,454,930 A | * | 10/1995 | Miura et al. | 205/159 |
| 5,608,943 A | | 3/1997 | Konishi et al. | 15/302 |
| 5,625,170 A | | 4/1997 | Poris | 177/50 |
| 5,651,865 A | | 7/1997 | Sellers | 204/192.13 |
| 5,705,223 A | | 1/1998 | Bunkofske | 427/240 |
| 5,718,813 A | | 2/1998 | Drummond et al. | 204/192.12 |
| 5,723,028 A | | 3/1998 | Poris | 204/231 R |
| 5,730,890 A | * | 3/1998 | Bickford et al. | 216/87 |
| 5,763,108 A | * | 6/1998 | Chang et al. | 428/694 |
| 6,024,856 A | * | 2/2000 | Haydu et al. | 205/84 |

FOREIGN PATENT DOCUMENTS

| | | |
|---|---|---|
| DE | 932 709 | 3/1955 |
| SU | 443108 | 12/1974 |

OTHER PUBLICATIONS

Lucio Colombo, "Wafer Back Surface Film Removal," Central R&D, SGS–Thompson, Microelectronics, Agrate, Italy, 6 pages, *No date available.

Semitool©, Inc., "Metallization & Interconnect," 1998, 4 pages ** No month available.

Verteq Online©, "Products Overview," 1996–1998, 5 pages, ** No month available.

Laurell Technologies Corporation, "Two control configurations available—see WS 400 or WS–400Lite." Oct. 19, 1998, 6 pages.

Peter Singer, "Tantalum, Copper and Damascene: The Future of Interconnects," Semiconductor International, Jun., 1998, pp. cover, 91–92, 94, 96 & 98.

Peter Singer, "Wafer Processing," Semiconductor International, Jun., 1998, p. 70.

European Search Report dated Aug. 26, 1999.

* cited by examiner

*Primary Examiner*—Kathryn Gorgos
*Assistant Examiner*—Thao Tran
(74) *Attorney, Agent, or Firm*—Moser, Patterson & Sheridan, LLP

(57) ABSTRACT

The present invention provides plating solutions, particularly metal plating solutions, designed to provide uniform coatings on substrates and to provide substantially defect free filling of small features, e.g., micron scale features and smaller, formed on substrates with none or low supporting electrolyte, ie., which include no acid, low acid, no base, or no conducting salts, and/or high metal ion, e.g., copper, concentration. Additionally, the plating solutions may contain small amounts of additives which enhance the plated film quality and performance by serving as brighteners, levelers, surfactants, grain refiners, stress reducers, etc.

33 Claims, No Drawings

ELECTRO DEPOSITION CHEMISTRY

This is a continuation of application Ser. No. 09/114,865 filed Jul. 13, 1998 now U.S. Pat. No. 6,113,771.

BACKGROUND OF THE INVENTION

1. Field of the Invention

This application claims priority from U.S. Provisional Application Serial No. 60/082,521, filed Apr. 21, 1998. The present invention relates to new formulations of metal plating solutions designed to provide uniform coatings on substrates and to provide defect free filling of small features, e.g., micron scale features and smaller, formed on substrates.

2. Background of the Related Art

Electrodeposition of metals has recently been identified as a promising deposition technique in the manufacture of integrated circuits and flat panel displays. As a result, much effort is being focused in this area to design hardware and chemistry to achieve high quality films on substrates which are uniform across the area of the substrate and which can fill or conform to very small features.

Typically, the chemistry, i e., the chemical formulations and conditions, used in conventional plating cells is designed to provide acceptable plating results when used in many different cell designs, on different plated parts and in numerous different applications. Cells which are not specifically designed to provide highly uniform current density (and the deposit thickness distribution) on specific plated parts require high conductivity solutions to be utilized to provide high "throwing power" (also referred to as high Wagner number) so that good coverage is achieved on all surfaces of the plated object. Typically, a supporting electrolyte, such as an acid or a base, or occasionally a conducting salt, is added to the plating solution to provide the high ionic conductivity to the plating solution necessary to achieve high "throwing power". The supporting electrolyte does not participate in the electrode reactions, but is required in order to provide conformal coverage of the plating material over the surface of the object because it reduces the resistivity within the electrolyte, the higher resistivity that otherwise occurs being the cause of the non-uniformity in the current density. Even the addition of a small amount, e.g., 0.2 Molar, of an acid or a base will typically increase the electrolyte conductivity quite significantly (e.g., double the conductivity).

However, on objects such as semiconductor substrates that are resistive, e.g., metal seeded wafers, high conductivity of the plating solution negatively affects the uniformity of the deposited film. This is commonly referred to as the terminal effect and is described in a paper by Oscar Lanzi and Uziel Landau, "Terminal Effect at a Resistive Electrode Under Tafel Kinetics", J. Electrochem. Soc. Vol. 137, No. 4 pp. 1139–1143, April 1990, which is incorporated herein by reference. This effect is due to the fact that the current is fed from contacts along the circumference of the part and must distribute itself across a resistive substrate. If the electrolyte conductivity is high, such as in the case where excess supporting electrolyte is present, it will be preferential for the current to pass into the solution within a narrow region close to the contact points rather than distribute itself evenly across the resistive surface, i.e., it will follow the most conductive path from terminal to solution. As a result, the deposit will be thicker close to the contact points. Therefore, a uniform deposition profile over the surface area of a resistive substrate is difficult to achieve.

Another problem encountered with conventional plating solutions is that the deposition process on small features is controlled by mass transport (diffusion) of the reactants to the feature and by the kinetics of the electrolytic reaction instead of by the magnitude of the electric field as is common on large features. In other words, the replenishment rate at which plating ions are provided to the surface of the object can limit the plating rate, irrespective of current. Essentially, if the current density dictates a plating rate that exceeds the local ion replenishment rate, the replenishment rate dictates the plating rate. Hence, highly conductive electrolyte solutions that provide conventional "throwing power" have little significance in obtaining good coverage and fill within very small features. In order to obtain good quality deposition, one must have high mass-transport rates and low depletion of the reactant concentration near or within the small features. However, in the presence of excess acid or base supporting electrolyte, (even a relatively small excess) the transport rates are diminished by approximately one half (or the concentration depletion is about doubled for the same current density). This will cause a reduction in the quality of the deposit and may lead to fill defects, particularly on small features.

It has been learned that diffusion is of significant importance in conformal plating and filling of small features. Diffusion of the metal ion to be plated is directly related to the concentration of the plated metal ion in the solution. A higher metal ion concentration results in a higher rate of diffusion of the metal into small features and in a higher metal ion concentration within the depletion layer (boundary layer) at the cathode surface, hence faster and better quality deposition may be achieved. In conventional plating applications, the maximum concentration of the metal ion achievable is typically limited by the solubility of its salt. If the supporting electrolyte, e.g., acid, base, or salt, contain a co-ion which provides a limited solubility product with the plated metal ion, the addition of a supporting electrolyte will limit the maximum achievable concentration of the metal ion. This phenomenon is called the common ion effect. For example, in copper plating applications, when it is desired to keep the concentration of copper ions very high, the addition of sulfuric acid will actually diminish the maximum possible concentration of copper ions. The common ion effect essentially requires that in a concentrated copper sulfate electrolyte, as the sulfuric acid ($H_2SO_4$) concentration increases (which gives rise to $H^{30}$cations and $HSO_4$–and $SO_4$–anions), the concentration of the copper (II) cations decreases due to the greater concentration of the other anions. Consequently, conventional plating solutions, which typically contain excess sulfuric acid, are limited in their maximal copper concentration and, hence, their ability to fill small features at high rates and without defects is limited.

Therefore, there is a need for new formulations of metal plating solutions designed particularly to provide good quality plating of small features, e.g., micron scale and smaller features, on substrates and to provide uniform coating and defect-free fill of such small features.

SUMMARY OF THE INVENTION

The present invention provides plating solutions with none or low supporting electrolyte, isle., which include no acid, low acid, no base, or no conducting salts, and/or high metal ion, e.g., Copper, concentration. Additionally, the plating solutions may contain small amounts of additives which enhance the plated film quality and performance by serving as brighteners, levelers, surfactants, grain refiners, stress reducers, etc.

DETAILED DESCRIPTION OF A PREFERRED EMBODIMENT

The present invention generally relates to electroplating solutions having low conductivity, particularly those solutions containing no supporting electrolyte or low concentration of supporting electrolyte, i.e., essentially no acid or low acid (and where applicable, no or low base) concentration, essentially no or low conducting salts and high metal concentration to achieve good deposit uniformity across a resistive substrate and to provide good fill within very small features such as micron and sub-micron sized features and smaller. Additionally, additives are proposed which improve leveling, brightening and other properties of the resultant metal plated on substrates when used in electroplating solutions with no or low supporting electrolyte, e.g., no or low acid. The invention is described below in reference to plating of copper on substrates in the electronic industry. However, it is to be understood that low conductivity electroplating solutions, particularly those having low or complete absence of supporting electrolyte, can be used to deposit other metals on resistive substrates and has application in any field where plating can be used to advantage.

In one embodiment of the invention, aqueous copper plating solutions are employed which are comprised of copper sulfate, preferably from about 200 to about 350 grams per liter (g/l) of copper sulfate pentahydrate in water ($H_2O$), and essentially no added sulfuric acid. The copper concentration is preferably greater than about 0.8 Molar.

In addition to copper sulfate, the invention contemplates copper salts other than copper sulfate, such as copper fluoborate, copper gluconate, copper sulfamate, copper sulfonate, copper pyrophosphate, copper chloride, copper cyanide and the like, all without (or with little) supporting electrolyte. Some of these copper salts offer higher solubility than copper sulfate and therefore may be advantageous.

The conventional copper plating electrolyte includes a relatively high sulfuric acid concentration (from about 45 g of $H_2SO_4$ per L of $H_2O$(0.45M) to about 110 g/L (1. 12M)) which ads provided to the solution to provide high conductivity to the electrolyte. The high conductivity is necessary to reduce the non-uniformity in the deposit thickness caused by the cell configuration and the differently shaped parts encountered in conventional electroplating cells. However, the present invention is directed primarily towards applications where the cell configuration has been specifically designed to provide a relatively uniform deposit thickness distribution on given parts. However, the substrate is resistive (typically having an electronical resistivity between 0.001 and 1000 Ohms/square cm) and imparts thickness non-uniformity to the deposited layer. Thus, among the causes of non-uniform plating, the resistive substrate effect may dominate and a highly conductive electrolyte, containing, e.g., high $H_2SO_4$ concentrations, is unnecessary. In fact, a highly conductive electrolyte (e.g., generated by a high sulfuric acid concentration) is detrimental to uniform plating because the resistive substrate effects are amplified by a highly conductive electrolyte. This is the consequence of the fact that the degree of uniformity of the current distribution, and the corresponding deposit thickness, is dependent on the ratio of the resistance to current flow within the electrolyte to the resistance of the substrate. The higher this ratio is, the lesser is the terminal effect and the more uniform is the deposit thickness distribution. Therefore, when uniformity is a primary concern, it is desirable to have a high resistance within the electrolyte. Since the electrolyte resistance is given by $1/\kappa\pi 1^2$, it is advantageous to have as low a conductivity, κ, as possible, and also a large gap, 1, between the anode and the cathode. Also, clearly, as the substrate radius, r, becomes larger, such as when scaling up from 200 mm wafers to 300 mm wafers, the terminal effect will be much more severe (e.g., by a factor of 2.25). By eliminating the acid, the conductivity of the copper plating electrolyte typically drops from about 0.5 S/cm (0.5 $ohm^1cm^1$) to about 1/10 of this value, i.e, to about 0.05 S/cm, making the electrolyte ten times more resistive.

Also, a lower supporting electrolyte concentration (e.g., sulfuric acid concentration in copper plating) often permits the use of a higher metal ion (e g., copper sulfate) concentration due to elimination of the common ion effect as explained above. Furthermore, in systems where a soluble copper anode is used, a lower added acid concentration (or preferably no acid added at Dll) minimizes harmful corrosion and material stability problems. Additionally, a pure or relatively pure copper anode can be used in this arrangement. Because some copper dissolution typically occurs in an acidic environment, copper anodes that are being used in conventional copper plating typically contain phosphorous. The phosphorous forms a film on the anode that protects it from excessive dissolution, but phosphorous traces will be found in the plating solution and also may be incorporated as a contaminant in the deposit. In applications using plating solutions with no acidic supporting electrolytes as described herein, the phosphorous Content in the anode may, if needed, be reduced or eliminated. Also, for environmental considerations and ease of handling the solution, a non acidic electrolyte is preferred.

Another method for enhancing thickness uniformity includes applying a periodic current reversal. For this reversal process, it may be advantageous to have a more resistive solution (i.e., no supporting electrolyte) since this serves to focus the dissolution current at the extended features that one would want to preferentially dissolve.

In some specific applications, it may be beneficial to introduce small amounts of acid, base or salts into the plating solution. Examples of such benefits may be some specific adsorption of ions that may improve specific deposits, complexation, pH adjustment, solubility enhancement or reduction and the like. The invention also contemplates the addition of such acids, bases or salts into the electrolyte in amounts up to about 0.4 M.

A plating solution having a high copper concentration (i.e., >0.8M) is beneficial to overcome mass transport limitations that are encountered when plating small features. In particular, because micron scale features with high aspect ratios typically allow only minimal or no electrolyte flow therein, the ionic transport relies solely on diffusion to deposit metal into these small features. A high copper concentration, preferably about 0.85 molar (M) or greater, in the electrolyte enhances the diffusion process and reduces or eliminates the mass transport limitations. The metal concentration required for the plating process depends on factors such as temperature and the acid concentration of the electrolyte. A preferred metal concentration is from about 0.8 to about 1.2 M.

The plating solutions of the present invention are typically used at current densities ranging from about 10 $mA/cm^2$ to about 60 $mA/cm^2$. Current densities as high as 100 $mA/cm^2$ and as low as 5 $mA/cm^2$ can also be employed under appropriate conditions. In plating conditions where a pulsed current or periodic reverse current is used, current densities in the flange of about 5 $mA/cm^2$ to about 400 $mA/cm^2$ can be used periodically.

The operating temperatures of the plating solutions may range from about 0° C. to about 95° C. Preferably, the solutions range in temperature from about 20° C. to about 50° C.

The plating solutions of the invention also preferably contain halide ions, such as chloride ions, bromide, fluoride, iodide, chlorate or perchlorate ions typically in amounts less than about 5 g/l. However, this invention also contemplates the use of copper plating solutions without chloride or other halide ions.

In addition to the constituents described above, the plating solutions may contain various additives that are introduced typically in small (ppm range) amounts. The additives typically improve the thickness distribution (levelers), the reflectivity of the plated film (brighteners), its grain size (grain refiners), stress (stress reducers), adhesion and wetting of the part by the plating solution (wetting agents) and other process and film properties. The invention also contemplates the use of additives to produce asymmetrical anodic transfer coefficient ($\alpha_a$) and cathodic transfer coefficient ($\alpha_a$) to enhance filling of the high aspect ratio features during a periodic reverse plating cycle.

The additives practiced in most of our formulations constitute small amounts (ppm level) from one or more of the following groups of chemicals:

1. Ethers and polyethers including polyalkylene glycols
2. Organic sulfur compounds and their corresponding salts and polyelectrolyte derivatives thereof.
3. Organic nitrogen compounds and their corresponding salts and polyelectrolyte derivatives thereof.
4. Polar heterocycles
5. A halide ion, e.g., $Cl^{31}$ Further understanding of the present invention will be had with reference to the following examples which are set forth herein for purposes of illustration but not limitation.

EXAMPLE I

An electroplating bath consisting of 210 g/L of copper sulfate pentahydrate was prepared. A flat tab of metallized wafer was then plated in this solution at an average current density of 40 mA/cm$^2$ and without agitation. The resulting deposit was dull and pink.

EXAMPLE II

To the bath in example I was then added 50 mg/L of chloride ion in the form of HCl. Another tab was then plated using the same conditions. The resulting deposit was shinier and showed slight grain refinement under microscopy.

EXAMPLE III

To the bath of Example II was added the following:

| Compound | Approximate Amount (mg/L) |
|---|---|
| Safranine O | 4.3 |
| Janus Green B | 5.1 |
| 2-Hydroxyethyl disulfide | 25 |
| UCON ® 75-H-1400 (Polyalkylene glycol with an average molecular weight of 1400 commercially available from Union carbide) | 641 |

Another tab was plated at an average current density of 10 mA/cm$^2$ without agitation. The resulting deposit had an edge effect but was shinier and showed grain refinement.

EXAMPLE IV

To the bath of Example II was added the following:

| Compound | Approximate Amount (mg/L) |
|---|---|
| 2-Hydroxy-Benzotriazole | 14 |
| Evan Blue | 3.5 |
| Propylene Glycol | 600 |

Another tab was plated at an average current density of 40 mA/cm$^2$ with slight agitation. The resulting deposit had an edge effect but was shinier and showed grain refinement.

EXAMPLE V

To the bath of Example II was added the following:

| Compound | Approximate Amount (mg/L) |
|---|---|
| Benzylated Polyethylenimine | 3.6 |
| Alcian Blue | |
| 2-Hydroxyethyl disulfide | 25 |
| UCON 75-H-1400 (Polyalkylene glycol with an average molecular weight of 1400 commerically available from Union carbide) | 357 |

Another tab was plated at an average current density of 20 mA/cm$^2$ without agitation. The Resulting deposit had and edge effect but was shinier and showed grain refinement.

EXAMPLE VI

A copper plating solution was made by dissolving 77.7 glitter of copper sulfate pentahydrate (0.3 Molar $CUSO_4 \times 5H_2O$), and 100 glitter of concentrated sulfuric acid and 15.5 cm$^3$/liter of a commercial additive mix in distilled water to make sufficient electrolyte to fill a 15 plating cell employing moderate flow rates and designed to plate 200 mm wafers. Wafers seeded with a seed copper layer, about 1500Å thick and applied by physical vapor deposition (PVD), were placed in the cell, face down, and cathodic contacts were made at their circumference. A soluble copper anode was placed about 4" below, and parallel to, the plated wafer. The maximal current density that could be applied, without 'burning' the deposit and getting a discolored dark brown deposit, was limited to 6 mA/cm$^2$. Under these conditions (6 mA/cm$^2$), the copper seeded wafer was plated for about 12 minutes to produce a deposit thickness of about 1.5 $\mu$m. The copper thickness distribution as determined from electrical sheet resistivity measurements was worse than 10% at 1 sigma. Also noted was the terminal effect which caused the deposit thickness to be higher next to the current feed contacts on the wafer circumference.

EXAMPLE VII

The procedure of example VI was repeated except that no acid was added to the solution. Also the copper concentration was brought up to about 0.8 M. Using the same hardware (plating cell) of example VI, same flow, etc. it was now possible to raise the current density to about 40 mAlcm2 without generating a discolored deposit. Seeded wafers were plated at 25 mA/cm$^2$ for about 3 min to produce the same thickness (about 1.5 $\mu$m) of bright, shiny copper. The thickness distribution was measured again (using electrical resistivity as in example VI) and was found to be 2–3% at 1 sigma. The terminal effect was no longer noticeable.

What is claimed is:

1. A method for electrolytic plating of copper on an electronically resistive seed layer on a semiconductor substrate, comprising:

connecting the electronically resistive seed layer to a negative terminal of an electrical power source;

disposing the electronically resistive seed layer and an anode in a solution comprising copper ions and less than about 0.4 molar concentration of a supporting electrolyte; and electrodepositing the copper onto the electronically resistive seed layer from the metal ions in the solution.

2. The method of claim 1, wherein the copper ions are provided by a copper salt selected from the group consisting of copper sulfate, copper fluoborate, copper gluconate, copper sulfamate, copper sulfonate, copper pyrophosphate, copper chloride, copper cyanide, and mixtures thereof.

3. The method of claim 2, wherein the copper ion concentration is greater than about 0.8 molar.

4. The method of claim 1, wherein the supporting electrolyte comprises sulfuric acid.

5. The method of claim 1, wherein the seed layer electronical resistivity is between 0.001 and 1000 Ohms/square cm.

6. The method of claim 1, wherein the seed layer is copper deposited on the semiconductor substrate by physical vapor deposition.

7. The method of claim 1, wherein the solution further comprises one or more additives selected from polyethers.

8. The method of claim 1, wherein the solution further comprises one or more additives selected from polyalkylene glycols.

9. The method of claim 1, wherein the solution further comprises one or more additives selected from the group consisting of organic sulfur compounds, salts of organic sulfur compounds, polyelectrolyte derivatives thereof, and mixtures thereof.

10. The method of claim 1, wherein the solution further comprises one or more additives selected from the group consisting of organic nitrogen compounds, salts of organic nitrogen compounds, polyelectrolyte derivatives thereof, and mixtures thereof.

11. The method of claim 1, wherein the solution further comprises polar heterocycles.

12. The method of claim 1, wherein the solution further comprises halide ions.

13. A method for electrolytic plating of copper on a metal seed layer on a semiconductor substrate, comprising:

connecting the metal seed layer to a negative terminal of an electrical power source;

disposing the substrate and an anode in a solution consisting essentially of water, a copper salts and less than about 0.4 molar concentration of a supporting electrolyte; and electrodepositing copper metal onto the substrate from the copper salts in the solution.

14. The method of claim 13, wherein the copper salt is selected from the group consisting of copper sulfate, copper fluoborate, copper gluconate, copper sulfamate, copper sulfonate, copper pyrophosphate, copper chloride, copper cyanide, and mixtures thereof.

15. The method of claim 13, wherein the copper salt has a concentration greater than about 0.8 molar.

16. The method of claim 13, wherein the supporting electrolyte comprises sulfuric acid.

17. The method of claim 13, wherein the metal seed layer is a copper seed layer deposited by physical vapor deposition.

18. A method for forming copper film, comprising:

electrodepositing copper onto a semiconductor substrate comprising a metal seed layer using an electrolyte that contains 0.4 M or less of a supporting electrolyte.

19. The method of claim 18, wherein the electrolyte further comprises additives selected from the group consisting of ethers or polyethers.

20. The method of claim 19, wherein the ethers comprise ethylene glycol and the polyethers comprise polyalkylene glycols.

21. The method of claim 18, where the metal seed layer is deposited by physical vapor deposition.

22. The method of claim 21, wherein the electrolyte comprises at least 0.8M copper concentration.

23. The method of claim 21, wherein the electrolyte comprises less than 0.05 M acid concentration.

24. The method of claim 23, wherein the acid concentration is a sulfuric acid concentration.

25. The method of claim 21, wherein the electrolyte further comprises additives selected from the group consisting of organic nitrogen compounds and their corresponding salts and polyelectrolyte derivatives thereof.

26. The method of claim 21, wherein the electrolyte further comprises additives selected from the group consisting of polar heterocycles.

27. The method of claim 21, wherein the electrolyte further comprises additives selected from the group consisting of aromatic heterocycles of the following formula: R'—R—R" where R is a nitrogen and/or sulfur containing aromatic heterocyclic compound, and R' and R" are the same or different and can be only 1 to 4 carbon, nitrogen, and/or sulfur containing organic group.

28. The method of claim 21, wherein the electrolyte further comprises additives selected from the group comprising halide ions.

29. The method of claim 21, wherein the electrolyte further comprises additives selected from the group consisting of organic sulfur compounds and their corresponding salts and polyelectrolyte derivatives thereof.

30. The method of claim 29, wherein the electrolyte further comprises additives selected from the group consisting of organic disulfide compounds of the general formula R—S—S—R' where R is a group with 1 to 6 carbon atoms and water soluble groups and R' is the same as R or a different group with 1 to 6 carbon atoms and water soluble groups.

31. The method of claim 29, wherein the electrolyte further comprises additives selected from the group consisting of quaternary amines.

32. The method of claim 29, wherein the electrolyte further comprises additives selected from the group consisting of activated sulfur compounds of the general formula.

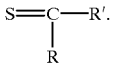

33. The method of claim 32, where R is an organic group that contains 0 to 6 carbon atoms and nitrogen and R' is the same as R or a different group that contains 0 to 6 carbon atoms and nitrogen.

* * * * *

UNITED STATES PATENT AND TRADEMARK OFFICE

CERTIFICATE OF CORRECTION

PATENT NO. : 6,350,366 B1 
DATED : February 26, 2002
INVENTOR(S) : Landau et al.

It is certified that error appears in the above-identified patent and that said Letters Patent is hereby corrected as shown below:

Column 2,
Line 41, please change "$H^{30}$" to -- $H^+$ --.
Line 56, please change "isle." to -- et al. --.

Column 3,
Line 36, please change "ads" to -- is --.
Line 63, please change "$1/\kappa\pi 1r^2$" to -- $1/\kappa\pi r^2$ --.

Column 4,
Line 12, please change "Dll" to -- all --.
Line 62, please change "flange" to -- range --.

Column 5,
Line 17, please change "$(\alpha_a)$" to -- $(\alpha_c)$ --.
Line 30, please change "$Cl^{31}$" to -- $Cl^-$ --.

Column 6,
Line 22, please insert -- 15 -- after "Alcian Blue".
Line 35, please change "glitter" to -- g/liter --.
Line 35, please change "$CUSO_4$" to -- $CuSO_4$ --.
Line 36, please change "glitter" to -- g/liter --.
Line 38, please delete "15".
Line 62, please change "mAlcm2" to -- $mA/cm^2$ --.

Signed and Sealed this

Eighth Day of July, 2003

JAMES E. ROGAN
*Director of the United States Patent and Trademark Office*